US008308500B2

(12) United States Patent
Davison et al.

(10) Patent No.: US 8,308,500 B2
(45) Date of Patent: Nov. 13, 2012

(54) POWER CONNECTOR SYSTEM

(75) Inventors: Andrew Charles Davison, Harrisburg, PA (US); John Eugene Westman, Harrisburg, PA (US); Steven Lee Flickinger, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 274 days.

(21) Appl. No.: 12/762,989

(22) Filed: Apr. 19, 2010

(65) Prior Publication Data

US 2011/0256748 A1 Oct. 20, 2011

(51) Int. Cl.
*H01R 4/50* (2006.01)

(52) U.S. Cl. ..... 439/345

(58) Field of Classification Search ..... 439/345, 439/258, 266, 10, 358, 352
See application file for complete search history.

(56) References Cited

U.S. PATENT DOCUMENTS

| | | | | |
|---|---|---|---|---|
| 6,837,732 | B2 * | 1/2005 | Pavlovic et al. | 439/352 |
| 6,910,911 | B2 * | 6/2005 | Mellott et al. | 439/358 |
| 8,128,422 | B2 * | 3/2012 | Mellott et al. | 439/180 |
| 2007/0141886 | A1 * | 6/2007 | Hammer et al. | 439/266 |
| 2010/0041257 | A1 * | 2/2010 | Beck et al. | 439/108 |
| 2010/0130042 | A1 * | 5/2010 | Gray | 439/176 |

* cited by examiner

*Primary Examiner* — Jean F Duverne

(57) ABSTRACT

A power connector system for an appliance includes a cable assembly comprising a plug having plug contacts terminated to discrete wires of the cable assembly. The power connector system also includes a receptacle assembly having a receptacle housing having a cavity that receives the plug. The receptacle housing is configured to be received in a cutout of a bezel of the appliance such that the cavity is accessible from an exterior of the appliance. The receptacle housing holds receptacle contacts that are mated to the plug contacts when the plug is received in the cavity.

20 Claims, 7 Drawing Sheets

POWER CONNECTOR SYSTEM

BACKGROUND OF THE INVENTION

The subject matter herein relates generally to appliances, and more particularly, to power connector systems for appliances.

Appliances, such as dryers, are powered by a power cord being terminated to a terminal block on a back side of the appliance. Typically, the power cord is plugged into a wall socket, and includes multiple wires with terminals at the ends thereof that are affixed to the terminal block. In some known systems, the terminals are ring terminals that are affixed to the terminal block using fasteners, such as bolts. Such systems are not without disadvantages. For instance, the terminals must be individually connected to the terminal block, which is time consuming. Such systems require a degree of know-how to safely and correctly attach the power cord to the appliance. Such systems require the use of tools to complete assembly and are prone to safety malfunctions if not properly installed.

A need remains for a power connector system that allows for safe connection of the power cord to the appliance. A need remains for a power connector system that allows for connection without tools or special knowledge.

BRIEF DESCRIPTION OF THE INVENTION

In one embodiment, a power connector system is provided for an appliance that includes a cable assembly comprising a plug having plug contacts terminated to discrete wires of the cable assembly. The power connector system also includes a receptacle assembly having a receptacle housing having a cavity that receives the plug. The receptacle housing is configured to be received in a cutout of a bezel of the appliance such that the cavity is accessible from an exterior of the appliance. The receptacle housing holds receptacle contacts that are mated to the plug contacts when the plug is received in the cavity.

In another embodiment, a power connector for an appliance is provided including a receptacle housing having a front and a rear. The receptacle housing has a cavity open at the front that is configured to receive a plug. The receptacle housing has contact channels extending between the cavity and the rear, and the receptacle housing has a latching feature configured to engage a bezel of the appliance to secure the receptacle housing to the bezel such that the cavity is accessible from an exterior of the appliance. Receptacle contacts are received in the contact channels. The receptacle contacts have mating ends within the cavity that are mated to corresponding plug contacts when the plug is received in the cavity.

DETAILED DESCRIPTION OF THE INVENTION

Figure 1:
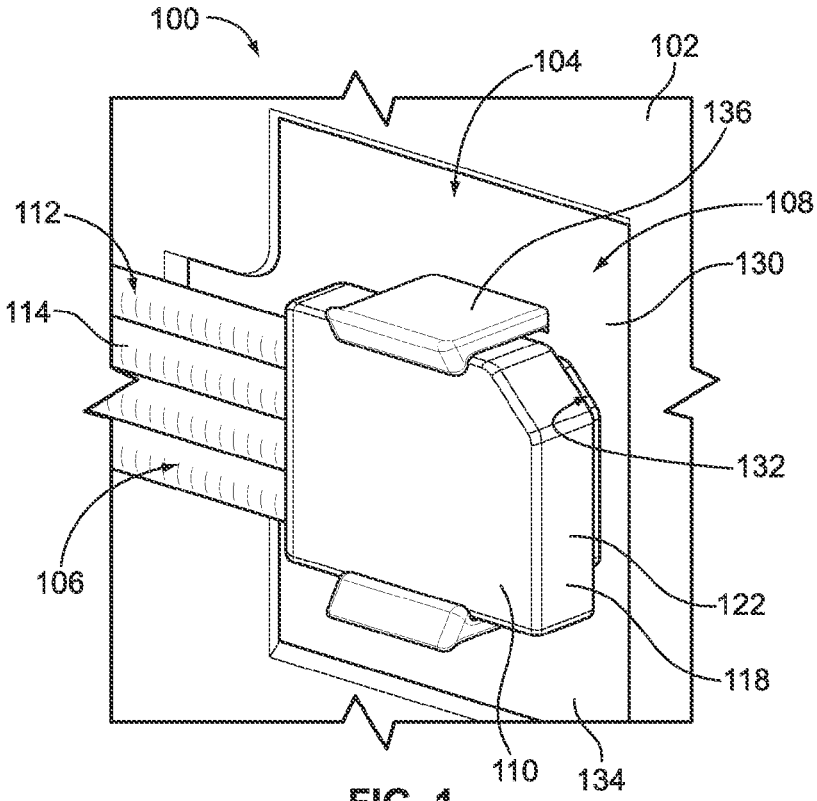
FIG. 1 illustrates a power connector system for an electronic device in a mated state.
Figure 2:
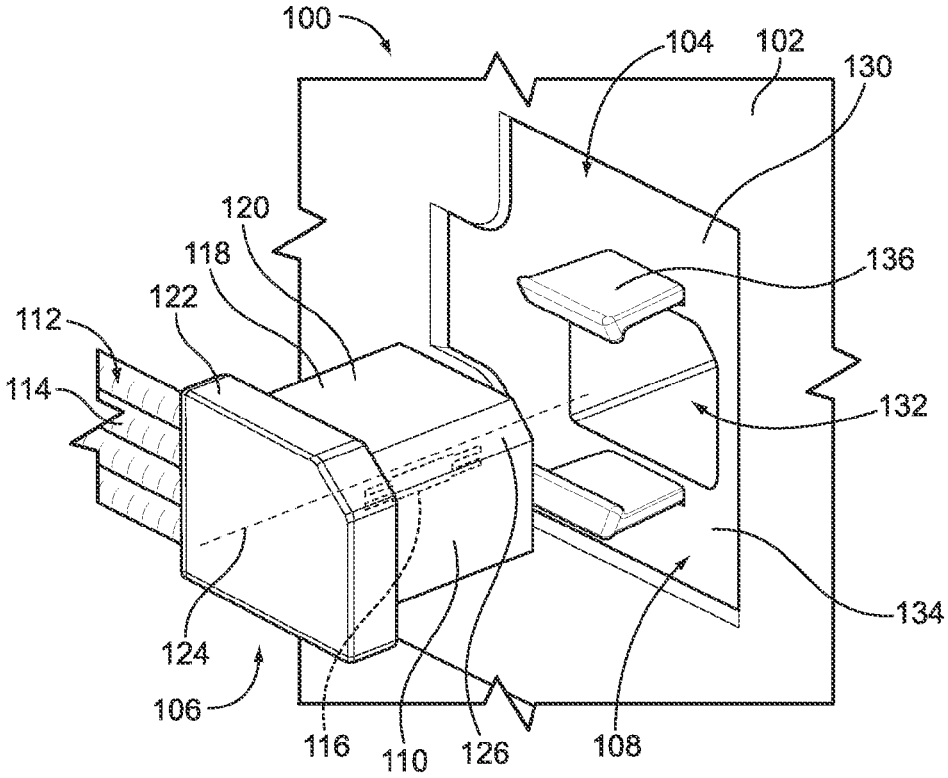
FIG. 2 illustrates the power connector system in an unmated state.

FIG. 1 illustrates a power connector system 100 for an electronic device in a mated state. FIG. 2 illustrates the power connector system 100 in an unmated state. The power connector system 100 may be used with any type of electronic device. For example, the power connector system 100 may be used with an appliance, such as, but not limited to, a dryer. The power connector system 100 supplies power to the electronic device.

The electronic device includes a bezel 102, which is the only part of the electronic device illustrated in the Figures. The bezel 102 defines a mounting location for the power connector system 100 and may form part of, or be attached to, a wall or outer casing of the electronic device. In the illustrated embodiment, the bezel 102 is a metal plate having a cutout 104. The cutout 104 provides an opening between an exterior and an interior of the electronic device. Electrical components of the electronic device may be housed in the interior, and power is supplied to the electrical components through the bezel 102 using the power connector system 100.

The power connector system 100 includes a cable assembly 106 and a receptacle assembly 108. The receptacle assembly 108 is coupled to the bezel 102 and is part of the electronic device. The receptacle assembly 108 defines a socket connector configured to receive a portion of the cable assembly 106.

The cable assembly 106 is mated with the receptacle assembly 108 to supply power to the electronic device. The cable assembly 106 includes a plug 110 at an end of a cable 112. The cable 112 includes discrete wires 114 being terminated to individual plug contacts 116 (shown in FIG. 2 in phantom). Optionally, the plug contacts 116 may be insulation displacement contacts that terminate to the wires 114. The plug contacts 116 may be terminated differently in alternative embodiments, such as by a crimped connection or another type of connection. The cable assembly 106 is connected to a power source at an end of the cable opposite the plug 110. For example, the cable assembly 106 may include a plug that is plugged into a wall socket.

The plug 110 includes a body 118 that holds the plug contacts 116 such that the plug contacts 116 may be simultaneously mated with the receptacle assembly 108 as a unit. The plug 110 and plug contacts 116 define a separable interface that may be mated and unmated quickly and easily by inserting the plug 110 into the receptacle assembly 108 and removing the plug 110 from the receptacle assembly 108. The body 118 may be manufactured from a rigid material, such as a plastic material. The body 118 includes a base 120 and a cap 122 at an end of the base 120. The wires 114 enter the body 118 at an edge of the cap 122 such that the wires 114 extend generally perpendicular to a central axis 124 of the plug 110. When mated with the receptacle assembly 108, the wires 114 extend generally along the bezel 102, as opposed to away from the bezel 102. As such, the cable assembly 106 has a low profile, which may allow the electronic device to sit flush with a wall or against another object without the cable 112 interfering with the positioning of the electronic device.

The base 120 is at least partially received in the receptacle assembly 108 when mated thereto. In an exemplary embodiment, the base 120 includes a keying feature 126 for keyed mating with the receptacle assembly 108. In the illustrated embodiment, the keying feature 126 is represented by a chamfered corner. Other embodiments may include a slot, a groove, a protrusion, a tab a particular shape of the body 118, and the like.

The receptacle assembly 108 includes a receptacle housing 130. The receptacle housing 130 is coupled to the bezel 102 such that the receptacle housing 130 is aligned with the cutout 104. Optionally, the receptacle housing 130 may be substantially flush with the bezel 102. In the illustrated embodiment, the receptacle housing 130 may be positioned behind the bezel 102. A portion of the receptacle housing 130 may extend through the cutout 104. Optionally, a seal (not shown) may be provided between the receptacle housing 130 and the bezel 102. The seal may prevent moisture from leaking into the interior of the electronic device through the cutout 104.

The receptacle housing 130 has a cavity 132 that receives the plug 110. The cavity 132 may be sized and shaped similar to the base 120 such that the base 120 may be received in the cavity 132. When the plug 110 is mated with the receptacle assembly 108, the cap 122 remains external to the cavity 132. Optionally, the cap 122 may sit flush against a front 134 of the receptacle housing 130.

In an exemplary embodiment, the receptacle assembly 108 includes a locking feature 136. The locking feature 136 engages the plug 110 to securely couple the plug 110 to the receptacle assembly 108. In the illustrated embodiment, the locking feature 136 is represented by locking tabs that extend forward from the front 134. The locking tabs are formed integral with the receptacle housing 130. The locking tabs engage the cap 122 to resist removal of the plug 110 from the cavity 132. Alternative types of locking features may be provided in alternative embodiments, such as a separate plate or cover that is coupled to the receptacle housing 130 and/or the bezel 102 such that the plate or cover is provided outward of the plug 110 to hold the plug 110 in the cavity 132. The plate or cover may be coupled using fasteners, latches or other fastening means.

Figure 3:
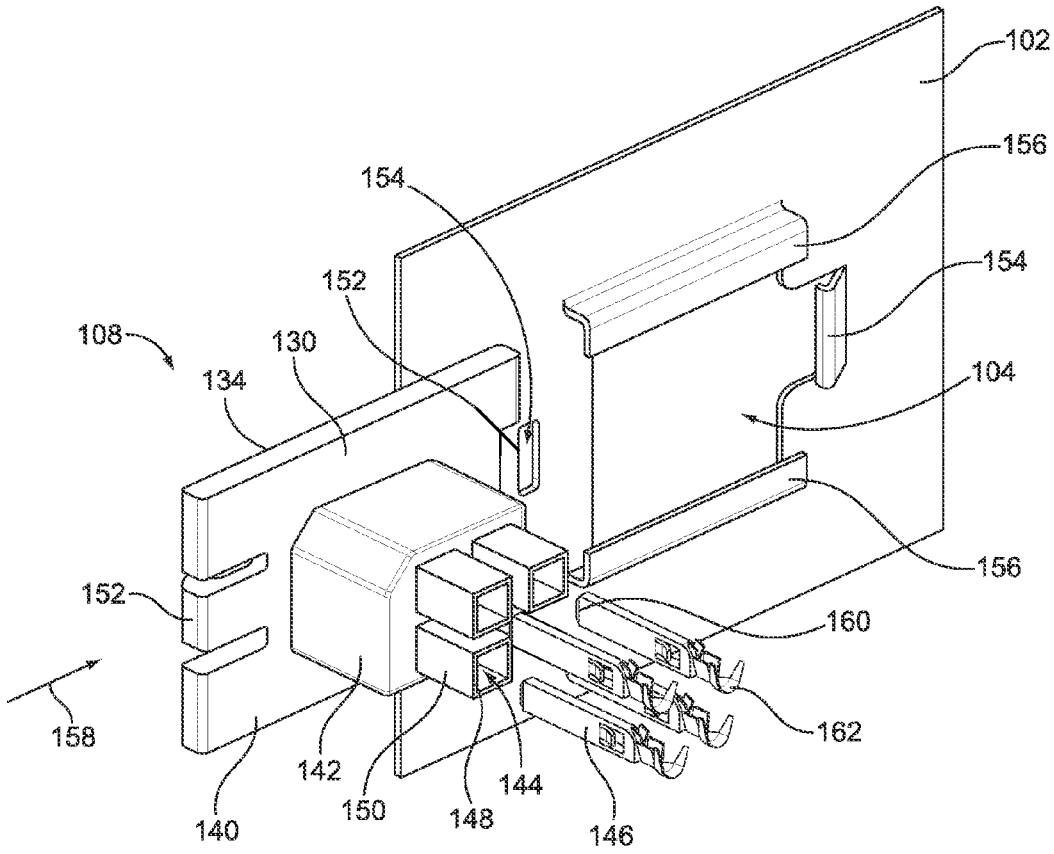
FIG. 3 is an exploded, rear perspective view of a receptacle assembly for the power connector system shown in FIGS. 1 and 2.

FIG. 3 is an exploded, rear perspective view of the receptacle assembly 108 illustrating the bezel 102 and the cutout 104. The receptacle housing 130 includes a base 140 and a hub 142 extending rearward from the base 140. The base 140 is configured to be secured to the bezel 102. The hub 142 surrounds the cavity 132 (shown in FIG. 2). The hub 142 includes a plurality of contact channels 144 that receive receptacle contacts 146. The contact channels 144 isolate the receptacle contacts 146 from one another and may entirely surround the receptacle contacts 146. The contact channels 144 extend between a rear 148 of the receptacle housing 130 and the cavity 132. The receptacle contacts 146 may be loaded into the contact channels 144 through the rear 148 such that portions of the receptacle contacts 146 are exposed within the cavity 132. Optionally, the hub 142 may include discrete towers 150 defining each of the contact channels 144.

In the illustrated embodiment, one of the towers 150 is shorter than the others. The shorter tower 150 allows one of the receptacle contacts to extend further into the cavity 132. Such receptacle contact may define a ground contact configured to mate prior to the other receptacle contacts 146, which may constitute power contacts. As such, the receptacle assembly 108 has a sequenced mating interface. The towers 150 hold the receptacle contacts 146 in different quadrants within the hub 142 and cavity 132.

The base 140 includes one or more latching features 152. The latching features 152 engage and interact with the bezel 102 to securely couple the receptacle housing 130 to the bezel 102. The bezel 102 includes corresponding latching features 154 that interact with the latching features 152 to secure the receptacle housing 130 to the bezel 102. The bezel 102 includes rails 156 that guide and position the receptacle housing 130 with respect to the bezel 102 and the cutout 104. The rails 156 engage a rear of the base 140 to hold the receptacle housing 130 against the bezel 102. The base 140 is generally planar and the front 134 abuts a rear of the bezel 102. In an exemplary embodiment, the receptacle housing 130 is slid into position against the rear of the bezel 102 to a final position. For example, the receptacle housing 130 may be slid in a mating direction represented by arrow 158 to a locked position. The latching features 152 engage the latching features 154 to securely couple the receptacle housing 130 to the bezel 102. The latching features 152, 154 may be any type of latching features including latches, tabs, windows, catches, and the like.

The receptacle contacts 146 include mating ends 160 and terminating ends 162. The mating ends 160 are configured to be mated to the plug contacts 116 (shown in FIG. 2). In the illustrated embodiment, the mating ends 160 define blade type contacts configured to be received in socket type contacts defined by the plug contacts 116. Alternatively, the mating ends 160 may be socket type contacts or other types of contacts. The terminating ends 162 are configured to be terminated to ends of wires. In the illustrated embodiment, the terminating ends 162 constitute terminal crimps that are crimped to ends of wires. Other types of terminating ends may be provided in alternative embodiments, such as insulation displacement contacts or other types of contacts. Optionally, each of the receptacle contacts 146 is identical to one another. The receptacle contacts 146 may define power contacts, signal contacts or ground contacts. In the illustrated embodiment, the receptacle contacts 146 include one ground contact and three power contacts.

Figure 4:
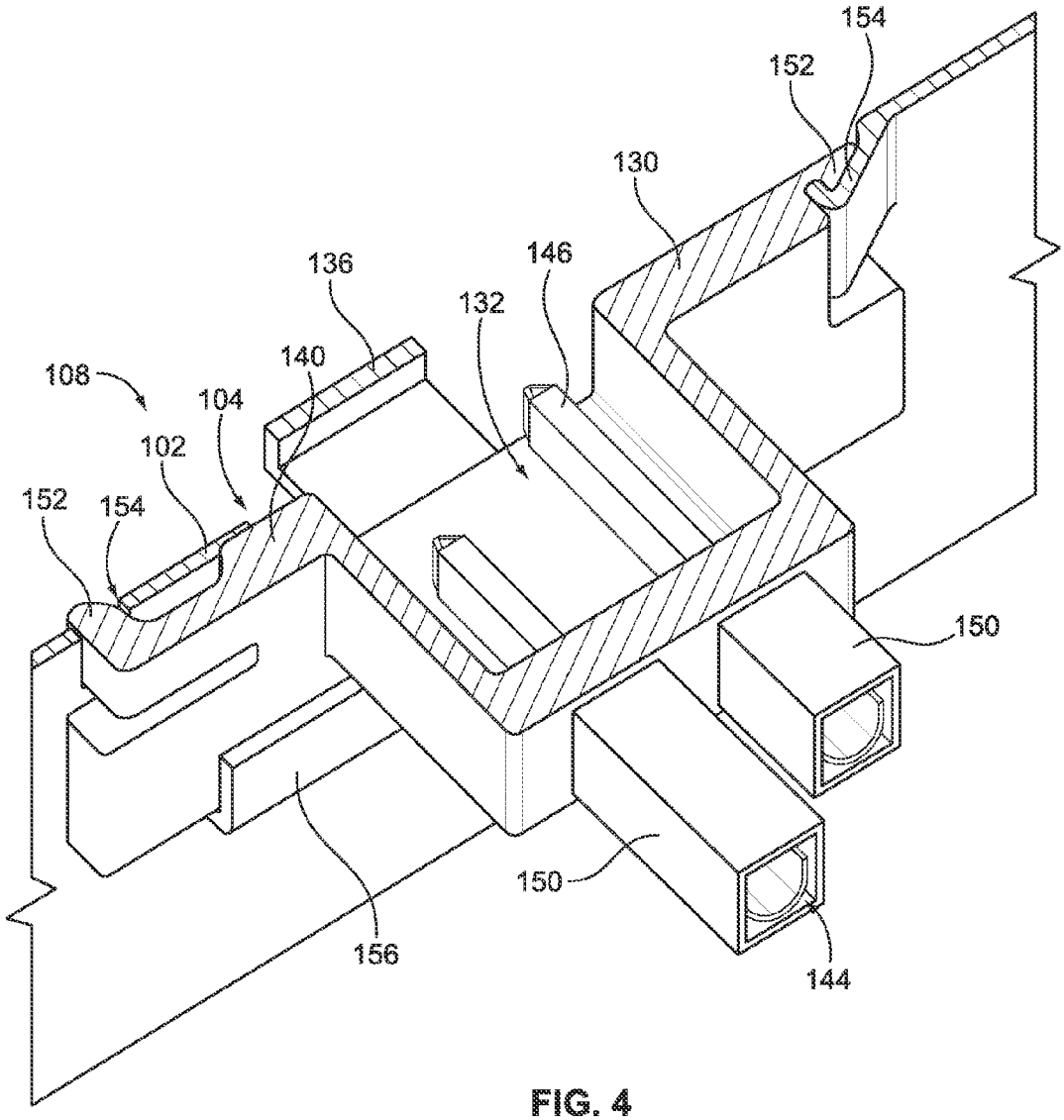
FIG. 4 is a partial sectional view of the receptacle assembly shown in FIG. 3.

FIG. 4 is a partial sectional view of the receptacle assembly 108 illustrating the receptacle contacts 146 held in the receptacle housing 130. The receptacle contacts 146 extend through the contact channels 144 into the cavity 132. The receptacle contacts 146 are exposed within the cavity 132 for mating with the plug contacts 116 (shown in FIG. 2).

In the illustrated embodiment, one of the receptacle contacts 146 extends further into the cavity 132 to define a ground contact, which mates with the corresponding plug contact 116 prior to other receptacle contacts 146 mating to corresponding plug contacts 116. The tower 150 corresponding to the ground contact is shorter than the other tower 150. Because the receptacle contacts 146 are identical to one another, having one of the towers 150 shorter than the other towers 150 allows one of the receptacle contacts 146 to extend further into the cavity 132 to define the ground contact and a sequenced mating interface. Alternatively, rather than having all of the receptacle contacts 146 identical to one another, the receptacle contacts 146 may be differently sized. For example, one of the receptacle contacts 146 may be longer than the other contacts to define a ground contact and extend further into the cavity 132. In other alternative embodiments, each of the receptacle contacts 146 may extend into the cavity 132 by the same amount. Optionally, the plug contacts 116 may define a sequenced mating interface in addition to, or instead of, the receptacle contacts 146.

The latching features 152 engage the latching features 154. For example, one of the latching features 152 (on the left side of FIG. 4) may constitute a deflectable latch received in an opening representing the corresponding latching feature 154 of the bezel 102. When the receptacle housing 130 is in the locked position, the latch is received in the opening, which restricts side to side movement of the receptacle housing 130 with respect to the bezel 102. Additionally, one of the latching features 152 (on the right side in FIG. 4) may constitute a catch that securely receives a deflectable latch representing the corresponding latching feature 154 of the bezel 102. When the receptacle housing 130 is in the locked position, the latch of the bezel engages the catch, which restricts side to side movement of the receptacle housing 130 with respect to the bezel 102. Any number of latching features 152, 154 may be provided in alternative embodiments. The latching features 152, 154 may be of different types in alternative embodiments.

The base 140 of the receptacle housing 130 is received in the rail 156, which restricts movement of the receptacle housing 130 away from the bezel 102. The rail 156 supports the receptacle housing 130. The locking feature 136 extends forward from the base 140 through the cutout 104.

Figure 5:
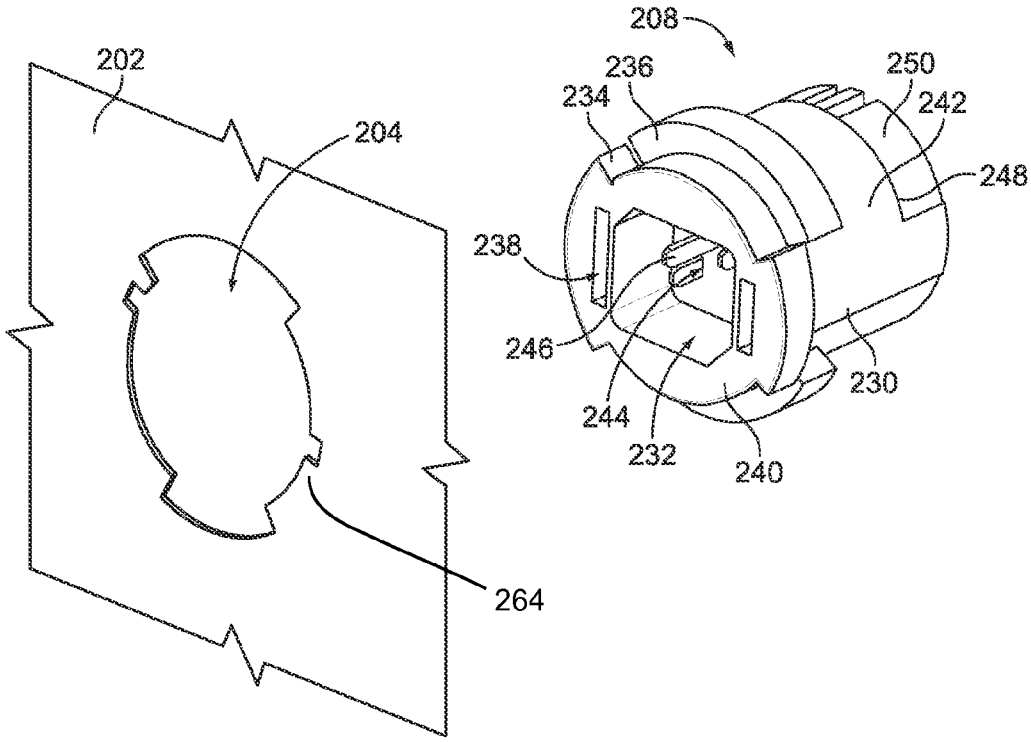
FIG. 5 is an alternative receptacle assembly for the power connector system being mated with a bezel of the electronic device.
Figure 6:
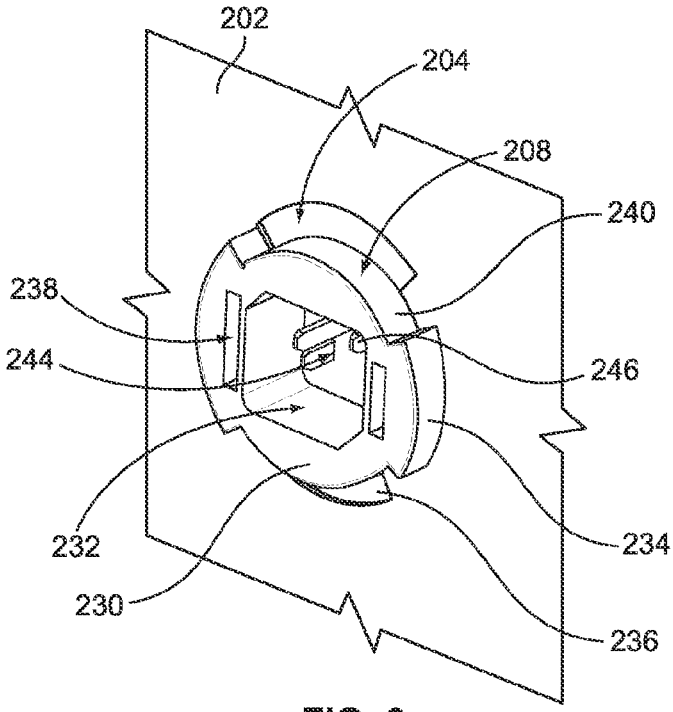
FIG. 6 illustrates the receptacle assembly shown in FIG. 5 mated with the bezel.

FIG. 5 is an alternative receptacle assembly 208 for the power connector system 100 (shown in FIG. 1) being mated with a bezel 202 of an electronic device. FIG. 6 illustrates the receptacle assembly 208 mated with the bezel 202 in a locked position. The bezel 202 includes a cutout 204 that receives the receptacle assembly 208. The receptacle assembly 208 is coupled to the bezel 202 and is part of the electronic device. The receptacle assembly 208 defines a socket connector configured to receive a cable assembly, such as the cable assembly 106 (shown in FIGS. 1 and 2).

The receptacle assembly 208 includes a receptacle housing 230. The receptacle housing 230 has a cavity 232 that receives a plug, such as the plug 110 (shown in FIGS. 1 and 2). The receptacle housing 230 is coupled to the bezel 202 such that the receptacle housing 230 is aligned with the cutout 204. Optionally, the receptacle housing 230 may be substantially flush with the bezel 202. A portion of the receptacle housing 230 may extend through the cutout 204. In an exemplary embodiment, the receptacle housing 230 includes a front flange 234 and a rear flange 236. The bezel 202 is captured between the front and rear flanges 234, 236 when the receptacle housing 230 is coupled to the bezel 202. The front flange 234 is laded through the cutout 204 and is positioned forward of the bezel 202 and engages a front of the bezel 202. The rear flange 236 remains behind the bezel 202 and engages a rear of the bezel 202. The cutout 204 is shaped to receive the front flange 234 therethrough, while the rear flange 236 engages the bezel 202 and does not fit through the cutout 204. Once positioned, the receptacle housing 230 is rotated to a locked position (shown in FIG. 6). Optionally, the receptacle housing 230 may be rotated approximately 90°. Once rotated to the locked position, both the front and rear flanges 234, 236 engage the bezel 202 to hold the receptacle housing 230 in place. Optionally, a seal (not shown) may be provided between the receptacle housing 230 and the bezel 202. The seal may prevent moisture from leaking into the interior of the electronic device through the cutout 204.

In an exemplary embodiment, the receptacle assembly 208 includes a locking feature 238. The locking feature 238 is represented by slots that are configured to receive a cover or other element that surrounds the plug to hold the plug in the cavity 232. Alternatively, the locking feature 238 may be represented by locking tabs similar to those illustrated in FIGS. 1 and 2 or other types of locking features to hold the plug in the cavity 232.

The receptacle housing 230 includes a base 240 and a hub 242 extending rearward from the base 240. The base 240 is configured to be secured to the bezel 202. The front and rear flanges 234, 236 are proved at the base 240. The base 240 and/or the hub 242 surround the cavity 232. The hub 242 includes a plurality of contact channels 244 that receive receptacle contacts 246. The contact channels 244 isolate the receptacle contacts 246 from one another and may entirely surround the receptacle contacts 246. The contact channels 244 extend between a rear 248 of the receptacle housing 230 and the cavity 232. The receptacle contacts 246 may be loaded into the contact channels 244 through the rear 248 such that portions of the receptacle contacts 246 are exposed within the cavity 232.

In an exemplary embodiment, the receptacle assembly 208 includes a cover 250 at a rear of the receptacle housing 230. The cover 250 is coupled to the receptacle housing 230.

Figure 7:
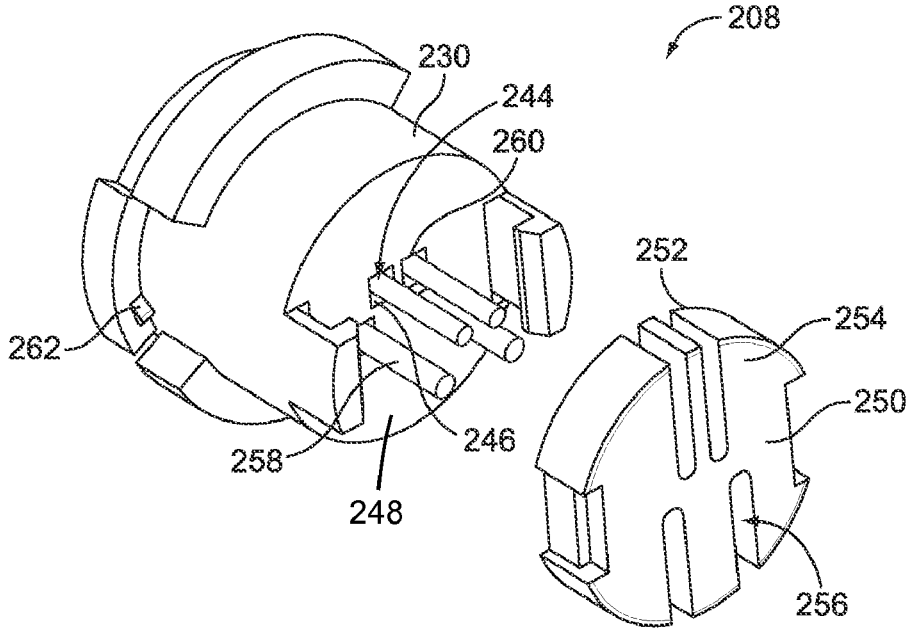
FIG. 7 is an exploded, rear perspective view of the receptacle assembly shown in FIG. 5.
Figure 8:
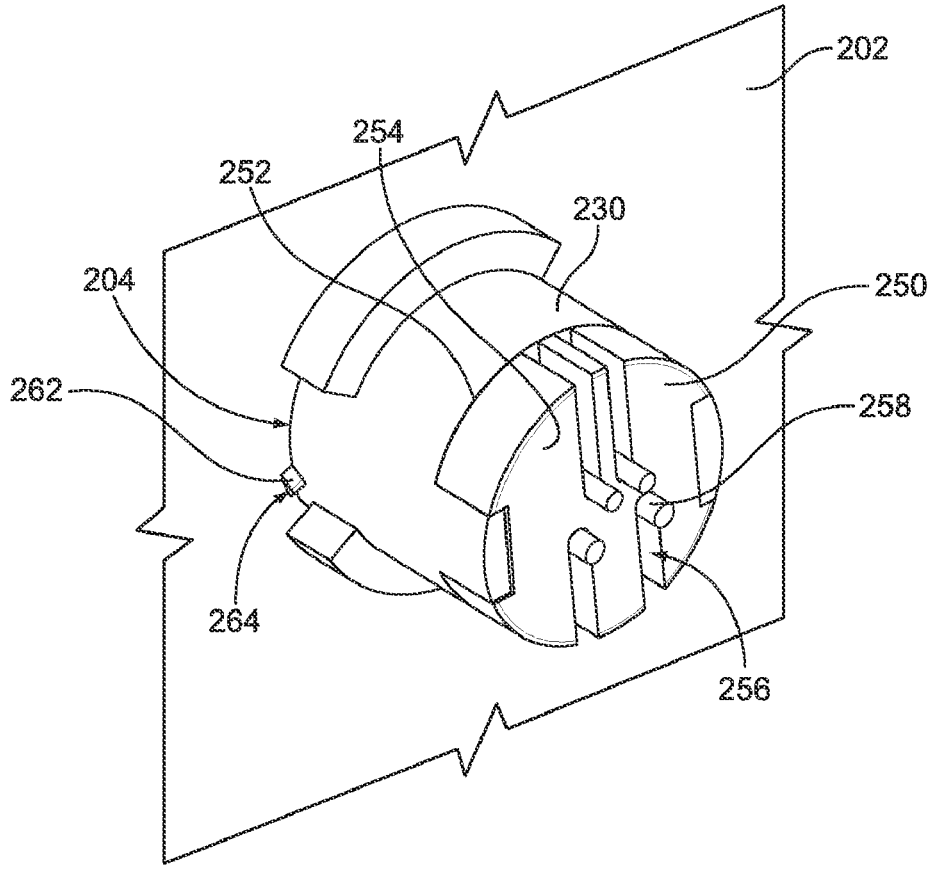
FIG. 8 is a rear perspective view of the receptacle assembly mated with the bezel.

FIG. 7 is an exploded, rear perspective view of the receptacle assembly 208 illustrating the cover 250. FIG. 8 is a rear perspective view of the receptacle assembly 208 mated with the bezel 202. The cover 250 includes a body having a front 252 and a rear 254. The cover 250 includes a plurality of wire slots 256 extending therethrough. The wire slots 256 are configured to receive individual wires 258 terminated to corresponding receptacle contacts 246 (shown in FIGS. 5 and 6). The wires slots 256 may be open from an outer edge of the cover 250 such that the wires 258 may be laced into the wire slots 256.

When coupled to the receptacle housing 230, the cover 250 covers a rear end 260 of the contact channels 244. As such, the cover 250 restricts rearward movement of the receptacle contacts 246 in the contact channels 244. For example, during mating with plug contacts, the receptacle contacts 246 may be forced rearward. The cover 250 blocks rearward movement of the receptacle contacts 246. Optionally, a seal (not shown) may be provided between the cover 250 and the receptacle housing 230. The seal may prevent moisture from leaking into the contact channels 244 to damage and/or corrode the wires 258 and/or the receptacle contacts 246.

The receptacle housing 230 includes one or more latching features 262. The latching features 262 engage and interact with the bezel 202 to securely couple the receptacle housing 230 to the bezel 202. The bezel 202 includes corresponding latching features 264 (shown in FIG. 8) that interact with the latching features 262 to secure the receptacle housing 230 to the bezel 202. In the illustrated embodiment, the latching features 262 are represented by protrusions and the latching features 264 are represented by openings in the cutout 204. When rotated to the locked position, the latching features 262, 264 engage one another to hold the relative position of the receptacle housing 230 and the bezel 202. For example, rotation of the receptacle housing 230 in an unmating direction is restricted.

Figure 9:
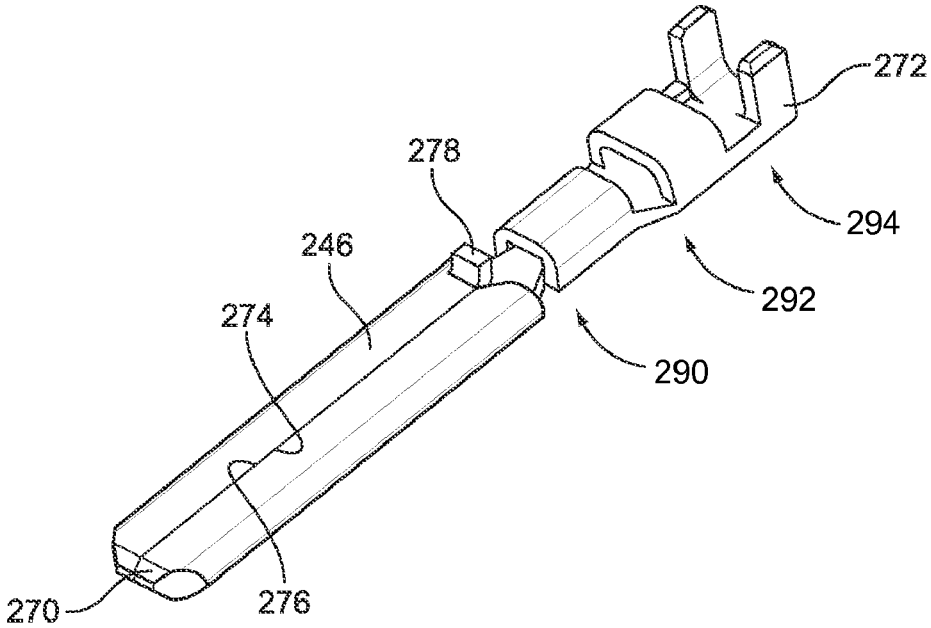
FIGS. 9 and 10 are top and bottom perspective views, respectively, of a receptacle contact for the receptacle assembly shown in FIG. 5.
Figure 10:
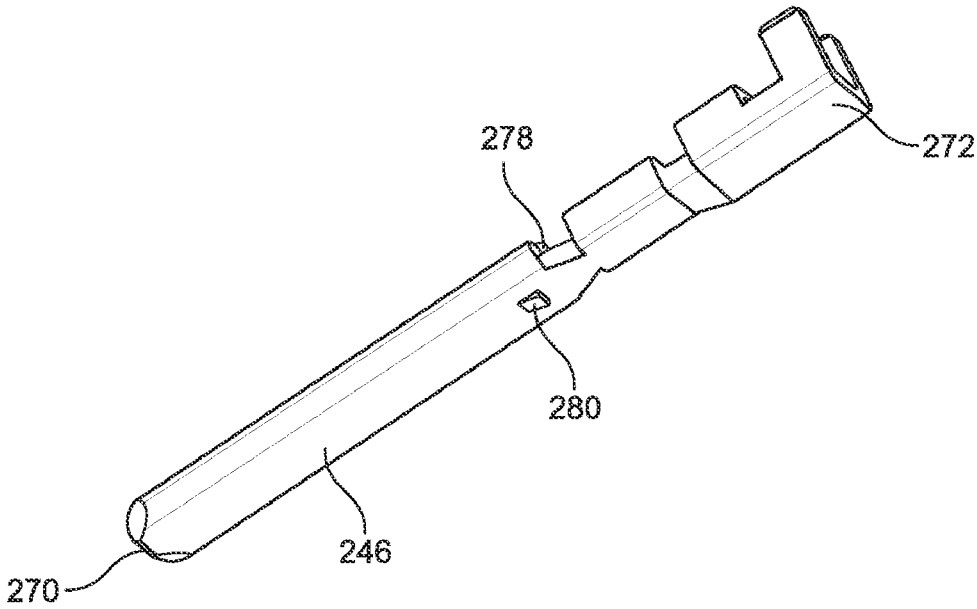

FIGS. 9 and 10 are top and bottom perspective views, respectively, of a receptacle contact 246. The receptacle contact 246 includes a mating end 270 and a terminating end 272. The mating end 270 is configured to be mated to a corresponding plug contact. In the illustrated embodiment, the mating end 270 defines a blade type contact configured to be received in a socket type contact defined by the plug contact. Alternatively, the mating end 270 may be a socket type contact or another type of contact. The terminating end 272 is configured to be terminated to an end of a wire (not shown). In the illustrated embodiment, the terminating end 272 constitutes a terminal crimp that is configured to be crimped to a wire. Other types of terminating ends may be provided in alternative embodiments, such as an insulation displacement end or another type of contact terminating end.

The receptacle contact 246 may be stamped and formed from a blank of material into the shape shown. For example, edges 274, 276 of the receptacle contact 246 may be rolled inward toward one another to create a contact having the shape illustrated in FIGS. 9 and 10, or other shapes in alternative embodiments. Such rolling at the mating end 270 provides a thickness to the receptacle contact 246.

In an exemplary embodiment, the receptacle contact 246 may include a flange 278 extending outward therefrom. As described in further detail below, the flange 278 may control a loading depth of the receptacle contact 246 into the contact channel 244. In the illustrated embodiment, the flange 278 extends from a top of the receptacle contact 246. The flange 278 is provided at one of the edges 274, however may be provided remote from the edge 274 or may be provided at both edges 274, 276 in alternative embodiments.

The receptacle contact 246 includes one or more tabs 280 extending therefrom. As described in further detail below, the tabs 280 may engage the contact channels 244 to provide a friction fit with the contact channels 244. In the illustrated embodiment, a single tab is provided on a bottom of the receptacle contact 246, however any number of tabs 280 and any location of tabs 280 may be utilized on alternative receptacle contacts.

The receptacle contact 246 includes a conductor crimp 290 that crimps the stripped wire. The receptacle contact 246 includes an insulation crimp 292 that crimps the insulation of the wire. The receptacle contact 246 includes legs 294 at the terminating end that are un-crimped. The legs 294 are used to provide a fixed surface that the cover 250 (shown in FIGS. 7 and 8) seats against.

Figure 11:
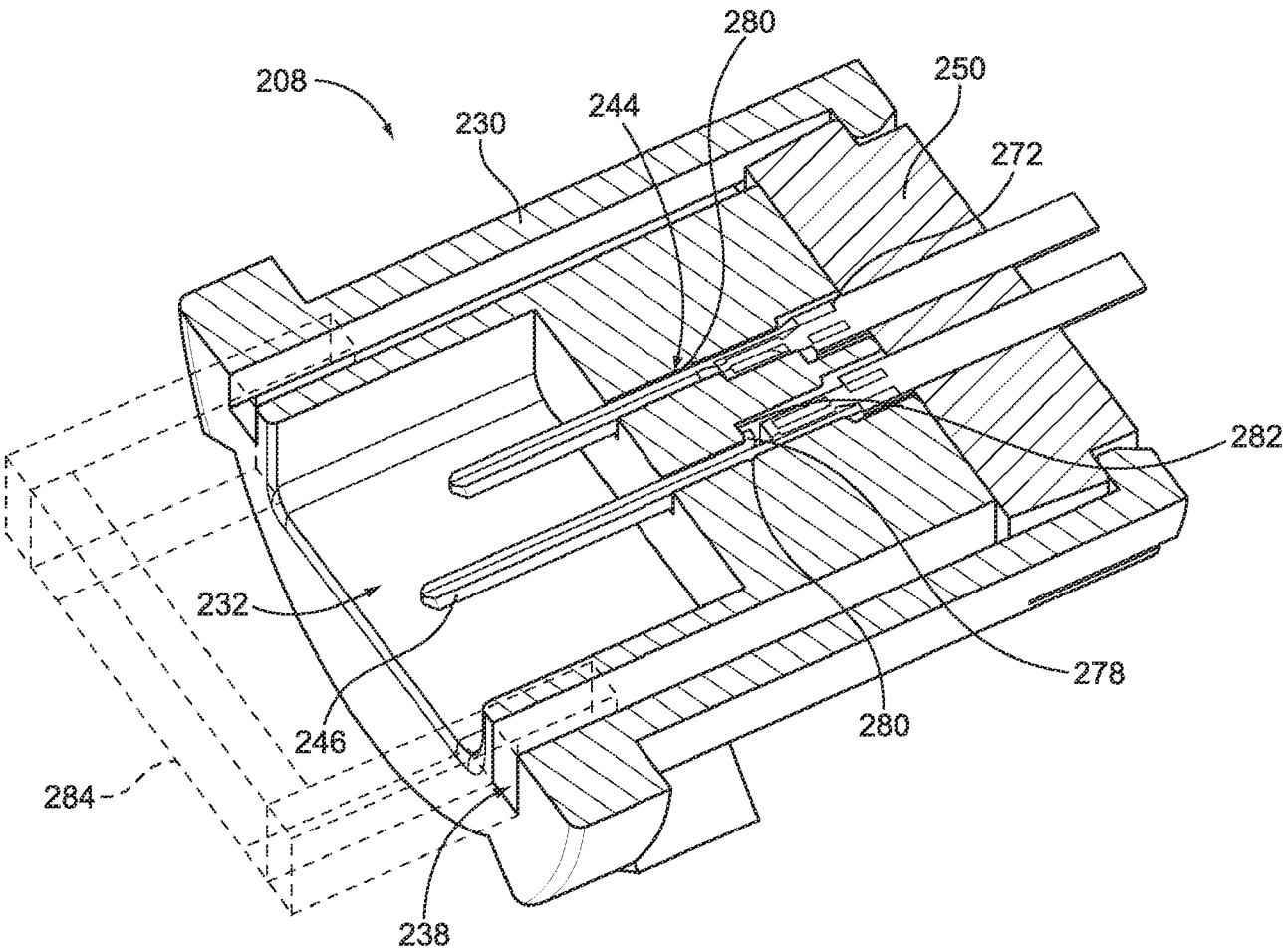
FIG. 11 is a sectional view of the receptacle assembly shown in FIG. 5.

FIG. 11 is a sectional view of the receptacle assembly 208 illustrating the receptacle contacts 246 held in the receptacle housing 230. The receptacle contacts 246 extend through the contact channels 244 into the cavity 232. The receptacle contacts 246 are exposed within the cavity 232 for mating with the plug contacts.

In the illustrated embodiment, one of the receptacle contacts 246 extends further into the cavity 232 to define a ground contact, which mates with the corresponding plug contact prior to other receptacle contacts 246 mating to corresponding plug contacts. The receptacle contacts 246 are loaded into the contact channels 244 until the flanges 278 engage corresponding shoulders 282 in the contact channels 244. The flanges 278 define a loading depth of the receptacle contacts 246 into the contact channels 244. The tabs 280 engage the contact channels 244 to hold the receptacle contacts 246 in the contact channels 244. The cover 250 is provided behind the contact channels 244. Optionally, the cover 250 may function as a backstop to stop rearward movement of the receptacle contacts 246 out of the contact channels 244. For example, if the terminating ends 272 engage the cover 250, then the cover 250 prevents further rearward movement of the receptacle contacts 246.

A locking feature 284 is illustrated in FIG. 11 in phantom. The locking feature 284 is a cover that is mated with the locking feature 238. The locking feature 284 may be a U-shaped clip that extends around a rear of the plug mated with the receptacle assembly 208. The locking feature 284 secures the plug in the cavity 232.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power connector system for an appliance comprising:

a cable assembly comprising a plug having plug contacts terminated to discrete wires of the cable assembly;

a receptacle assembly comprising a receptacle housing having a cavity that receives the plug, the receptacle housing being configured to be received in a cutout of a bezel of the appliance such that the cavity is accessible from an exterior of the appliance, the receptacle housing holding receptacle contacts, the receptacle contacts being mated to the plug contacts when the plug is received in the cavity, wherein the receptacle assembly further comprises a cover having a plurality of wire slots, the receptacle contacts being terminated to ends of wires, the wires extending through the wires slots of the cover.

2. The system of claim 1, wherein the receptacle assembly includes a locking feature engaging the plug to securely couple the plug to the receptacle assembly.

3. The system of claim 1, wherein the receptacle contacts include a ground contact and a power contact, the ground contact and power contact being staggered within the cavity such that the ground contact mates with the corresponding plug contact prior to the power contact mating with the corresponding plug contact.

4. The system of claim 1, wherein the receptacle contacts include a ground contact and a power contact both having a common length, the ground contact being loaded further into the cavity such that the ground contact is positioned forward of the power contact.

5. The system of claim 1, wherein the receptacle housing is configured to be coupled to the bezel in a direction parallel to the bezel, a front of the receptacle housing being slid along the bezel to a mated position.

6. The system of claim 1, wherein the receptacle housing includes a latching feature configured to engage the bezel to securely couple the receptacle housing to the bezel to hold a relative position of the receptacle housing with respect to the bezel.

7. The system of claim 1, wherein a portion of the receptacle housing is loaded through the cutout of the bezel, the receptacle housing being rotated with respect to the bezel to a locked position.

8. The system of claim 1, the cover being positioned behind the receptacle contacts to hold the receptacle contacts within the receptacle housing.

9. The system of claim 1, wherein the receptacle assembly includes a locking feature configured to be coupled to at least one of the receptacle housing or the bezel, the locking feature engaging the plug to restrict removal of the plug from the cavity.

10. A power connector system for an appliance comprising:

a cable assembly comprising a plug having plug contacts terminated to discrete wires of the cable assembly;

a receptacle assembly comprising a receptacle housing having a cavity that receives the plug, the receptacle housing being configured to be received in a cutout of a bezel of the appliance such that the cavity is accessible from an exterior of the appliance, the receptacle housing holding receptacle contacts, the receptacle contacts being mated to the plug contacts when the plug is received in the cavity, wherein the receptacle housing includes contact channels receiving the receptacle contacts, the receptacle contacts include flanges engaging the receptacle housing to limit insertion of the receptacle contacts into the contact channels.

11. A power connector system for an appliance comprising:

a cable assembly comprising a plug having plug contacts terminated to discrete wires of the cable assembly;

a receptacle assembly comprising a receptacle housing having a cavity that receives the plug, the receptacle housing being configured to be received in a cutout of a bezel of the appliance such that the cavity is accessible from an exterior of the appliance, the receptacle housing holding receptacle contacts, the receptacle contacts being mated to the plug contacts when the plug is received in the cavity, wherein the receptacle housing includes contact channels receiving the receptacle contacts, the receptacle contacts include barbs engaging the contact channels to hold the receptacle contacts in the contact channels by a friction fit.

12. A power connector for an appliance comprising:

a receptacle housing having a front and a rear, the receptacle housing having a cavity open at the front and being configured to receive a plug, the receptacle housing having contact channels extending between the cavity and the rear, the receptacle housing having a latching feature configured to engage a bezel of the appliance to secure the receptacle housing to the bezel such that the cavity is accessible from an exterior of the appliance; and receptacle contacts received in the contact channels, the receptacle contacts having mating ends within the cavity, the mating ends being mated to corresponding plug contacts when the plug is received in the cavity, wherein the receptacle contacts includes a round contact and a power contact, the ground contact being positioned within the cavity such that the ground contact is configured to mate with a corresponding plug contact prior to the power contact mating with the corresponding plug contact.

13. The connector of claim 12, wherein the receptacle housing is configured to be coupled to the bezel such that the front is substantially flush with an interior surface of the bezel and aligned with a cutout in the bezel.

14. The connector of claim 12, wherein the receptacle housing includes front flanges and rear flanges, the receptacle housing being configured to be coupled to the bezel such that the front flanges engage an exterior surface of the bezel and the rear flanges engage an interior surface of the bezel.

15. The connector of claim 12, wherein the receptacle assembly includes a locking feature configured to engage the plug to securely couple the plug to the receptacle assembly.

16. The connector of claim 12, further comprising a cover being coupled to the receptacle housing, the cover being positioned behind the receptacle contacts to hold the receptacle contacts within the receptacle housing.

17. The connector of claim 12, further comprising a locking feature configured to be coupled to at least one of the receptacle housing or the bezel, the locking feature engaging the plug to restrict removal of the plug from the cavity.

18. A power connector for an appliance comprising:

a receptacle housing having a front and a rear, the receptacle housing having a cavity open at the front and being configured to receive a plug, the receptacle housing having contact channels extending between the cavity and the rear, the receptacle housing having a latching feature configured to engage a bezel of the appliance to secure the receptacle housing to the bezel such that the cavity is accessible from an exterior of the appliance; and receptacle contacts received in the contact channels, the receptacle contacts having mating ends within the cavity, the mating ends being mated to corresponding plug contacts when the plug is received in the cavity, wherein the receptacle contacts include a single ground contact and three power contacts arranged in different quadrants of the cavity.

19. The connector of claim 18, wherein the receptacle assembly includes a locking feature configured to engage the plug to securely couple the plug to the receptacle assembly.

20. The connector of claim 18, wherein the ground contact is positioned within the cavity such that the ground contact is configured to mate with a corresponding plug contact prior to the power contacts mating with corresponding plug contacts.

* * * * *